US006953870B2

(12) United States Patent
Yan et al.

(10) Patent No.: US 6,953,870 B2
(45) Date of Patent: Oct. 11, 2005

(54) SELF-PROPELLED LIQUID FUEL

(76) Inventors: Tsoung Y Yan, 2427 Fairmount Ave., Philadelphia, PA (US) 19130; Tsang-po Yan, 7-2 Lane 10, Hsin-chung St, Taipei (TW); Tsung-che Yen, 103 Hongtsou, Hsiaying, Tainan Hsien (TW)

( * ) Notice: Subject to any disclaimer, the term of this patent is extended or adjusted under 35 U.S.C. 154(b) by 195 days.

(21) Appl. No.: 10/227,637

(22) Filed: Aug. 26, 2002

(65) Prior Publication Data

US 2004/0038166 A1 Feb. 26, 2004

(51) Int. Cl.[7] ..... C10L 3/12

(52) U.S. Cl. ..... 585/14; 585/6; 208/15; 44/300; 48/197 FM; 48/199 FM

(58) Field of Search ..... 585/6, 14

(56) References Cited

U.S. PATENT DOCUMENTS

| | | | | | |
|---|---|---|---|---|---|
| 3,640,819 | A | * | 2/1972 | Watkins | 208/111.15 |
| 3,718,575 | A | * | 2/1973 | Watkins | 208/59 |
| 4,640,675 | A | | 2/1987 | Green et al. | 431/2 |
| 4,643,666 | A | | 2/1987 | Green et al. | 431/4 |
| 5,315,054 | A | * | 5/1994 | Teel | 585/14 |
| 5,380,346 | A | * | 1/1995 | Fritz | 44/401 |
| 6,193,874 | B1 | | 2/2001 | Chern | 208/15 |

* cited by examiner

*Primary Examiner*—Ellen M. McAvoy

(57) ABSTRACT

A composition and use of economical, high efficient burning and environmentally friendly self-propelled liquid fuel for domestic, commercial and industrial application is provided. The fuel could be self-contained for application in small and isolated locations. The fuel is characterized by containing light hydrocarbons as a propellant and low value, heavier hydrocarbon by-products from the refining operations.

16 Claims, 2 Drawing Sheets

SELF-PROPELLED LIQUID FUEL

CROSS—REFERENCE TO RELATED APPLICATION

Not Applicable

BACKGROUND—FIELD OF INVENTION

This invention relates to compositions of self-propelled liquid fuel for applications as domestic, commercial, and industrial fuel, particularly, in areas and at times when low ambient temperature conditions are less frequently encountered. The fuel is characterized by consisting of broad boiling range of hydrocarbon mixtures including low value ethane as a propellant and heavy components, up to octane/octene and using as gaseous fuels in a novel container and delivering system.

BACKGROUND—DESCRIPTION OF PRIOR ART

For modern living, fuels for domestic, commercial and industrial heating are absolutely necessary To fulfill the requirements for these application, these fuels are characterized by cleanliness, safe, convenient and economical to use. Conventional liquefied petroleum gas (LPG) meets these characteristics, and is the most favored fuels. There are four grades of LPG, namely, commercial propane, commercial propane/butane (PB) mixtures, commercial butanes and special duty propane. PB mixtures are the most widely used fuel because of its availability and cost.

PB mixtures consist essentially of propane and butanes and of some other minor light components and heavy components. The composition of LPG depends on the availability of the components from the refinery and the climate of the area. For example, a composition of LPG available in India is, propane, 27.5%; iso-butane, 14.7%; n, butane, 55.7% and C 5, 2.0%. In application, PB mixtures is stored as liquid in a cylinder tinder high pressure. By reducing the pressure, the PB mixtures is weathered off and turned into gases and used as gaseous fuel for combustion. In the weathering process, the light components are selectively vaporized and used up first. The remaining mixture in the cylinder becomes heavier and heavier as the mixture is used up. In the end, the vapor pressure of the heavy components, such as pentanes, hexanes and octanes are too low at the ambient temperature and left in the cylinder. The heavy components accumulate and increase in volume as the cylinder is filled each time. As a result, the specified amount of useable fuel in each cylinder couldn't be delivered to the consumers. To minimize this problem, the product specification of LPG in ASTM D 1835 requires that the max. 95% evaporation temperature at 2.2° C. To meet this specification, almost all pentanes and heavier components have to be excluded from LPG (PB mixtures) product. Thus, the yield of high value LPG product from the refinery is limited leading to unfulfilled demand for LPG in many parts of the world.

The light hydrocarbons, such as butanes, pentanes and hexanes are by-products from the refinery. In the past, they can be pumped into gasoline and sold at good price. However, the tightening regulation of gasoline specification, particularly, the Reed vapor pressure and high octane number of the gasoline, makes it impossible to use up these components to produce high value gasoline. The situation will become more and more serious as the gasoline specification is further tightened. The alternative uses of these surplus by-products are low value refinery fuels and steam cracker feed. Research and development of these by-products for high value use is the objective of intensive research around the world.

In U.S. Pat. No. 6,193,874, a high combustion efficiency fuel is described. The fuel gas is produced by pumping petroleum to a light oil composed of butane, pentane, hexane and octane. In the process, some of the light oil can be carried along to form part of the gaseous fuel product leading to conversion of some light oil to high value gaseous fuel. However, it is complicated to operate and is not practical for domestic and commercial application. In addition, the quality of the gaseous fuel varies as the composition of the light oil changes during the course of pumping light fuel gas through it. Thus, combustion of such fuel can never be optimum using a conventional heater.

In U.S. Pat. No. 4,640,675, hydrogen deficient hydrocarbon fuel is improved in burning characteristics by dissolving a light, hydrogen rich hydrocarbon. The quality of hydrocarbon mixture for combustion is the average properties of the mixtures. Thus, the combustion quality of the hydrocarbon mixtures can be tailor made by adjusting the composition of the mixture.

In U.S. Pat. No. 4,643,666, it is further shown that the burning characteristics of a relatively hydrogen deficient fuel are improved by physically mixing with, but not dissolving in, the fuel a light hydrocarbon rich vapor, such as hydrogen and/or methane, ethane, etc.

The prior art for using relatively heavy hydrocarbon as gaseous fuel suffers from a number of disadvantages including:

a. In conventional systems, the composition in the cylinder varies as it is using up, leading to non-optimal air/fuel ratio and non-optimal combustion efficiency.

b. The non-optimal and incomplete combustion in the conventional systems leads to increased air pollution.

c In the conventional systems, the heavy residual is left in the cylinder and cannot be burned. These residues accumulate in the cylinder as the cylindered is refilled every time, short changing the users and consumers.

d. The heavier hydrocarbon by-products from petroleum refining cannot be used for production of high value LPG product and has to be downgraded to low value refinery fuels.

e. The production of high value fuel, such as LPG, is limited by the availability of either propane/propene or butane/butene, or both f. It is expensive to upgrade the heavier hydrocarbons, such as butane, pentanes and hexanes to high value gasoline by extensive catalytic processing.

There is a need in the industry for production of a better, cleaner and more economical gaseous fuel and development of high value uses for heavier hydrocarbon byproducts from refineries.

The disclosure of the above patents and literature are incorporated herein by reference.

SUMMARY OF THE INVENTION

The present invention provides a composition and use of economical, high efficient burning and environmentally friendly gaseous fuel for domestic, commercial and industrial application The fuel combustion system could also be self-contained for application in small and isolated sites, such as a farm, individual household, building and construction sites. The fuel system is characterized by containing light hydrocarbon as a propellant and low value, heavier hydrocarbon by-products from the refinery processes.

Objects and Advantages

Accordingly, several objects and advantages of the present invention are:

a. To provide a gaseous combustion system using liquid fuel of constant composition for efficient and optimal combustion.

b. To provide a gaseous combustion system for reduced air pollution.

c. To provide a gaseous combustion system to deliver designed quantity of fuel to consumer consistently.

d. To provide an efficient gaseous combustion system using low value, relatively heavy hydrocarbon mixture by-products from refinery operation.

e. To increase the yield of premium liquid fuel by including low value, heavier hydrocarbons in the formulation.

f. To provide a means to upgrade low value refinery by-product to premium products by use of a simple operation of blending.

Further objectives and advantages will become apparent from a consideration of the ensuing description and drawings.

BRIEF DESCRIPTION OF THE DRAWING

The embodiment of the invention illustrated in the schematic drawings.

DESCRIPTION OF THE INVENTION

Figure 1:
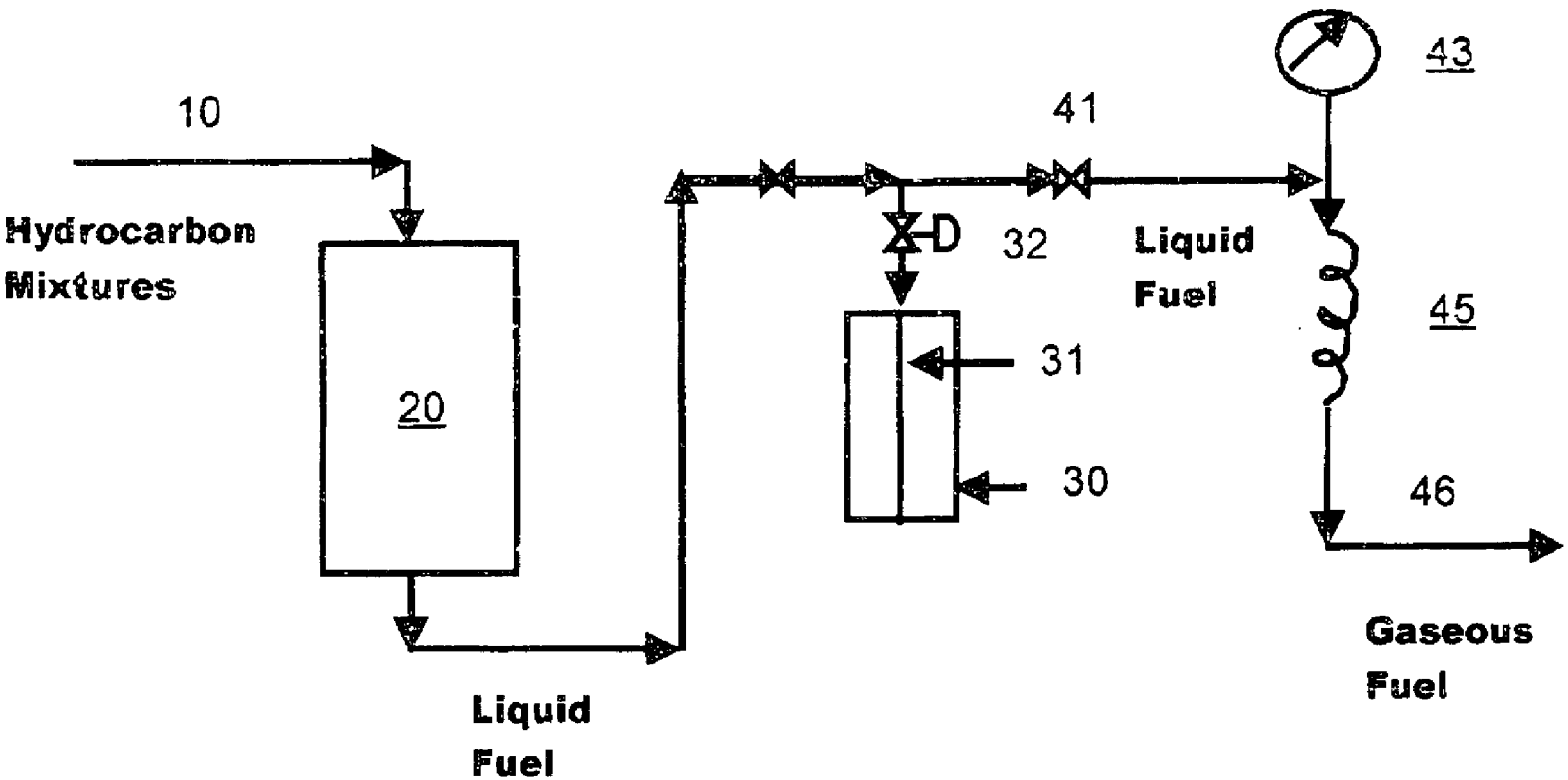
FIGS. 1 and 2 shows a high pressure mixing tank for mixing and the liquefaction of the fuel streams, a cylinder for filling with the liquid fuel to be delivered to the consumers and a connection to a heating device at a consumer's location. The preferred embodiments of two different feasible schemes are shown in FIGS. 1 and 2.

Accordingly, the critical elements in the combustion system of the present invention are three, namely, formulation of the fuel composition, process equipment and configuration, and operation conditions and procedures of the system.

Fuel Composition

The present invention relates to formulation, processing and delivering of the liquid fuel to consumers for applications in gaseous heating devices. Accordingly, the fuels of present invention must meet two requirements 1) It must be liquid at about 300 psig or lower and ambient temperature to maximize the holding capacity of a cylinder for distribution to consumers 2) It's vapor pressure must be about 0 psig at ambient temperature or higher so as to vaporize for combustion as gaseous fuel, and minimize or eliminate the residue in the cylinder to assure delivery of accurate quantity of the fuel to the consumers.

The basic components of the fuel in the present invention are methane, ethane, propane/propylene, butane/butene, pentane/pentene, hexane/hexene, and octane/octene. Those components are generally available in a refinery as various processing streams, for example, methane, ethane and trace of propane as refinery fuel gas; propane/propylene and butane/butenes as PB mixtures, pentane/hexanes as light naphthas, and heptanes and octanes as raffinate. The relative amount of the streams varies depending on the refinery configurations. The relative amounts in terms of ratios in a typical refinery could be: propane/propylene to butane/butene of 0.5 to 3 and propane/propylene to pentane/pentene of 1.5 to 10. These available streams are blended according to the recipe to obtain a fuel meeting the two requirement shown above. The recipe can be calculated using a typical flash calculation program or a simulation program with the objective function to maximize the revenue for the refinery. It is most desirable to use up all the by-product streams in formulating the liquid fuel of present invention. Thus, the optimum composition of the liquid fuel of present invention depends on the configuration and operation of the refinery.

In the present invention, it is desirable to include as much low value by-products, such as pentane/pentene and hexane/hexene as possible. It has been discovered in the present invention that a propellant can be included in the formulation to increase the allowable contents of pentane/pentene and higher components. It has been further discovered that ethane/ethylene is one of the best propellants for the present invention. However, excess amount of propellant cannot be used because the fuel mixture cannot be completely liquefied at the set pressure of 300 psig or lower. The desirable range of ethane/ethylene in the formulation depends on the rest of the composition in the formulation and is generally, in the range of 0.5 and 15% and 1 to 10% is preferred.

According to the present invention, the composition ranges of the fuel mixtures for typical refineries are: methane, 0 to 1%; ethane/ethylene, 0 to 15%; propane/propylene, 0 to 80%; butane/butene, 0 to 50%; petane/pentene, 0 to 20%; hexane/hexene, 0 to 15%; heptane/heptene, 0 to 5% and octane/octene, 0 to 0.5%

Process Equipment and Configuration

Figure 2:
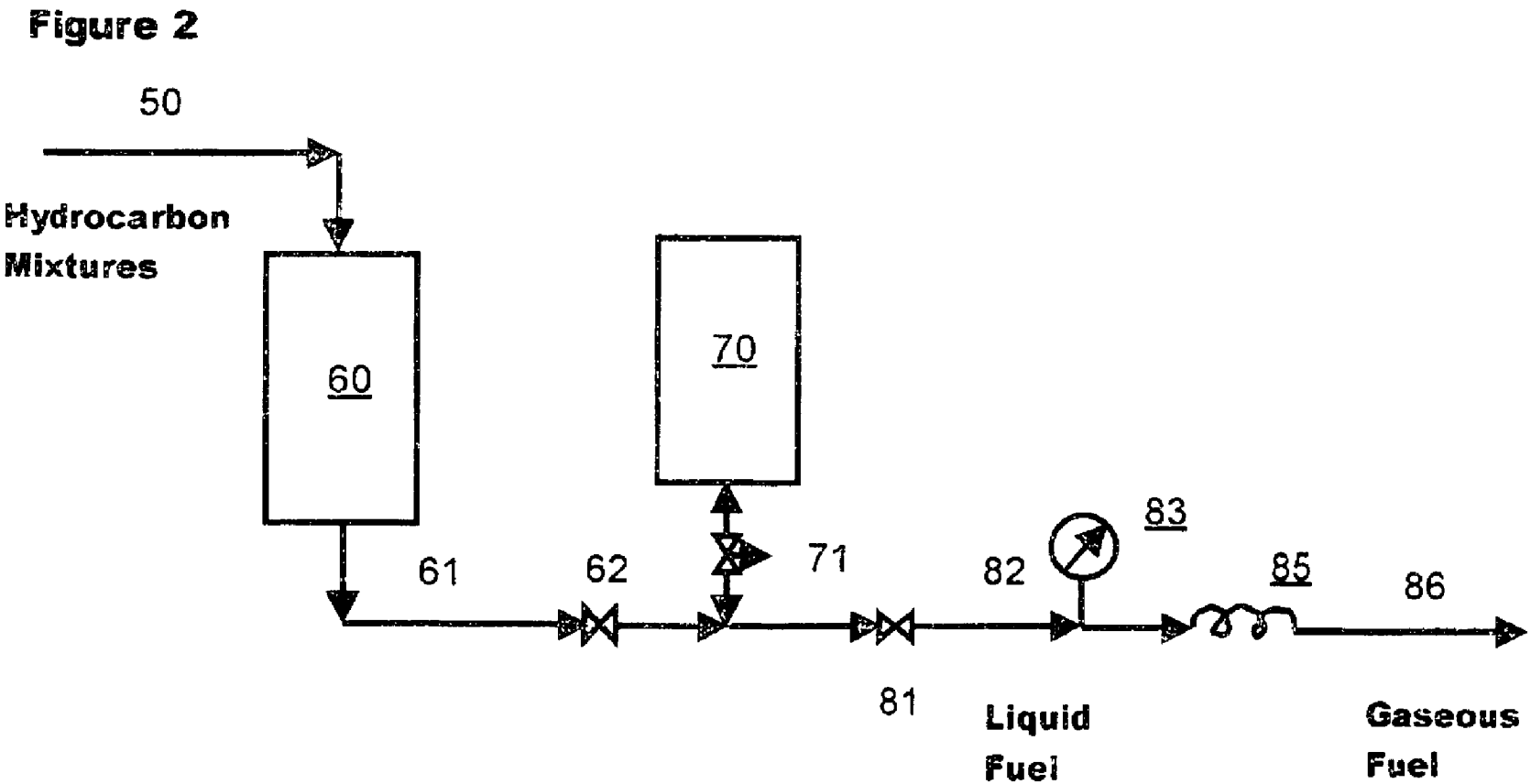

A preferred embodiment of the present invention is shown in FIGS. 1 and 2. In accordance with the drawing, the refinery streams are fed from line 10 to high pressure mixing tank 20 in proportions required by the recipe. In tank 20, the fuel mixture is mixed and liquefied completely to form a homogeneous liquid fuel. This mixing and liquefaction step can be either continuous or batch operation. Said liquid fuel flows through line 21 and a connecter 22 to fill the receiver 30. Receiver 30 is a high-pressure cylinder equipped with a valve 32 and a connecting line 31 extending from valve 32 to essentially the bottom of the cylinder. After cylinder 30 is filled, it is removed and delivered to the consumers. At the consumer site, cylinder 30 is connected to connecter 41 and line 42. Said liquid fuel flows through line 42 and pressure regulator 43 to reduce the pressure to ambient or the level required for the heater. Upon reduction of pressure, the liquid fuel is vaporized to gaseous fuels and flows through line 46 to the heater. Heater 45 supplies the heat of vaporization to complete the vaporization. For the liquid fuel according to the present invention, the heat of vaporization is rather small at about 0.1 cal per gram. For temperate area, the heat required for vaporization can be supplied by absorbing ambient heat from the surface of line 46. When the duty of the heater is large, more heat is required for vaporization. This heat can be supplied using heater 45. Heater 45 can be a coil to increase surface to increase heat absorption from the ambient, an electrical heater or a heat exchanger.

The propellant, such as ethane/ethylene and propane/propylene are critical in operating the system of the present invention. As the content of the liquid fuel in cylinder 30 is depleted in use, said propellant is selectively vaporized to form vapor phase to maintain the pressure of cylinder 30, so that the liquid fuel can be delivered to the heater at the constant rate.

In the configuration depicted in FIG. 2, the system is similar to that depicted in FIG. 1 except that the cylinder 30 is replaced with cylinder 70. The inlet/outlet for 70 is located at the bottom. In accordance with the drawing, FIG. 2, the refinery streams are fed from line 50 to high pressure mixing tank 60 in proportions required by the recipe. In tank 50, the fuel mixture is mixed and liquefied completely to form a homogeneous liquid fuel. This mixing and liquefaction step can be either continuous or batch operation. Said liquid fuel flows through line 61 and a connecter 62 to fill the receiver 70. 70 is a high-pressure cylinder equipped with a valve 71 at the bottom. After cylinder 70 is filled, it is removed and delivered to the consumers. At the consumer site cylinder 70 is connected to connecter 81 and line 82. Said liquid fuel flows through line 82 and pressure regulator 83 to reduce the pressure to ambient or the level required for the heater. Upon reduction of pressure, the liquid fuel is vaporized to gaseous fuels and flows through line 86 to the heater. Heater 85 supplies the heat of vaporization to complete the vaporization. For the liquid fuel according to the present invention, the heat of vaporization is rather small at about 0.1 cal per gram. For temperate area, the heat required for vaporization can be supplied by absorbing ambient heat from the surface of line 86. When the duty of the heater is large, more heat is required for vaporization. This heat can be supplied using heater 85. Heater 85 can be a coil to increase surface to increase heat absorption from the ambient, an electrical heater or a heat exchanger. The propellant, such as ethane/ethylene and propane/propylene are critical in operating the system of the present invention. As the content of the liquid fuel in cylinder 70 is depleted in the use, said propellant is selectively vaporized to form vapor phase to maintain the pressure of cylinder 70, so that the liquid fuel can be delivered to the heater at the constant rate.

Operation Conditions and Procedures

The liquid fuel of present invention can be used in a wide range of ambient temperatures and best in temperate areas with ambient temperatures ranging from 0 to 40° C. For use in extremely cold temperatures, the moisture content of the fuel has to be controlled so that solid hydrate will not form to plug the lines, and duty of the heater has to be adjusted to supply enough heat for complete evaporation of the fuel. The composition of the hydrocarbon mixtures has to be adjust so that it is completely liquefied at about 100 to 500 psig and preferably 150 to 300 psig at ambient temperatures of −20 to 40° C., and preferably at 0 to 35° C., and completely in gas state at 10 psig to ambient pressure at ambient temperatures of −20 to 40° C. and preferably 0 to 35° C. Typically, the gas mixture is liquefied at about 210 psig and filled to the cylinder 30 or 70 at about 200 psig. It is critical to liquefy the mixture completely so that the cylinder can be filled with a liquid fuel uniform in composition for delivery to the consumers.

In mixing and liquefaction of the hydrocarbon mixtures, the process can be either continuous or batch operation. In the continuous operation, the component streams in proportion to the desired and optimum composition are pumped in to the mixing tank, Tank 20 in FIG. 1 or Tank 60 in FIG. 2, simultaneously at a pressure equal to the liquefaction pressure. In the batch process, the component streams can be fed to the mixing tank 20 or 60 simultaneously or one at a time. It is desirable to pumping the components in the order of increasing volatility, that is, in the order of octane/octene, heptane/heptene, hexane/hexene, pentane/pentene, butane/butene, propane/propylene, ethane/ethylene and methane. The lighter components, propane/propylene, ethane/ethylene, and methane can be pumped in at the liquefaction pressure to liquefy the whole content of the mixture in the tank The equipment design is critical in using the liquid fuel of present invention which is a hydrocarbon mixture of wide boiling range. In the conventional cylinder, the valve is opened to release the gas for combustion. Since the liquid fuel is a mixture, the light components are preferentially vaporized and used up first. As the cylinder is depleted, the liquid level in the cylinder drops and a vapor phase is formed to fill the space The composition of the gas in the vapor is in equilibrium of the liquid phase and can be calculated using a flash calculation program. The gas phase is rich in lighter components because of preferential vaporization. It is this light gas in the vapor phase that is used up preferentially. As a result, the gas composition of the gas becomes heavier and heavier all the time as the content of the liquid fuel in the cylinder is depleted. In fact, the heavier components cannot vaporize finally and left as residue in the tank, short changing the consumers As the composition of the fuel gas changes, air to fuel ratio should be increased all the time to optimize the combustion. However, the heaters in domestic and commercial application are set for a constant air to fuel ratio, so that fuel combustion from a conventional cylinder is non-optimum for most of the time. In order to maintain an optimal combustion in a heater with a constant air to fuel ratio, the composition of gaseous fuel from the cylinder must be reasonably constant. In the present invention, delivery of a constant fuel composition is achieved by withdrawing fuel from the liquid phase exclusively rather than from gas phase as in the conventional system.

To withdrawn fuel from the liquid phase exclusively, two types of cylinders, 30 in FIG. 1 and 70 in FIG. 2 can be used. In cylinder 30, tube 31 connecting to the exit valve 32 reaches essentially to the bottom of cylinder 30. Thus, the fuel can be withdrawn from the lower, liquid phase exclusively to maintain the gaseous fuel composition nearly constant. In cylinder 70 in FIG. 2, the exit is at the bottom of the cylinder, so the liquid fuel is withdrawn exclusively from the lower liquid phase.

In the present invention, it is desirable to:

1) Include as much low value, pentane and heavier by-product as possible.
2) Keep the composition of the gaseous fuel for combustion constant.
3) Eliminate or minimize the residue in the cylinder as the gaseous fuel is exhausted from the cylinder.

In the present invention, these three seemingly contradicting requirements are solved by using propellants to drive off the heavy liquid fuel exclusively from a novel cylinder. The useful propellants include methane, ethane/ethylene and propane/propylene, and ethane/ethylene is most preferred. Ethane/ethylene, particularly, impure ethane/ethylene is often available inexpensively as refinery fuel gas. As a propellant, at least 1%, preferably, 2 to 10% of ethane/ethylene can be used. As the liquid fuel in the cylinder is depleted, the propellants selectively vaporizes to form the gas phase and provide pressure to deliver the liquid fuel. Since the quantity of the propellant is small, the composition of liquid phase and in turn, the gaseous fuel delivered remains essentially the same throughout the usage of the cylinder. Meanwhile, through pushing of the propellant, the liquid fuel can be withdrawn from the cylinder completely.

The invention is illustrated by the following examples in which all parts, proportions and percentages are by weight unless the contrary is stated.

EXAMPLES

In the examples, hydrocarbon mixtures of various compositions are assumed. A flash calculation program is used to calculate the vapor/liquid equilibrium of the mixture at feed liquefaction and product vaporization conditions. The conditions are 200 psig and 20° C., and 0 psig and 20° C. to simulate the feed of liquefaction and product vaporization, respectively. For the composition to be useful, two conditions has to be met, namely, the feed has to be completely in a single phase of liquid and the product has to be completely in vapor phase. The results are shown in Table 1 for examples 1 through 7.

TABLE 1

| | Example | | | | | | |
|---|---|---|---|---|---|---|---|
| | 1 | 2 | 3 | 4 | 5 | 6 | 7 |
| Comp % | | | | | | | |
| Methane | 6.50 | 6.91 | 6.75 | 6.69 | 0.00 | 0.00 | 0.00 |
| Ethane | 6.94 | 3.69 | 7.20 | 7.14 | 7.66 | 7.67 | 7.62 |
| Propane | 47.32 | 50.29 | 49.12 | 48.71 | 52.21 | 52.31 | 51.98 |
| Butane | 17.95 | 19.08 | 18.63 | 18.48 | 19.80 | 19.84 | 19.72 |
| Pentane | 11.57 | 12.30 | 12.01 | 11.91 | 12.76 | 12.79 | 12.71 |
| Hexane | 7.26 | 6.43 | 6.28 | 6.23 | 6.68 | 6.69 | 7.98 |
| Heptane | 2.08 | 1.11 | 0.00 | 0.64 | 0.69 | 0.69 | 0.00 |
| Octane | 0.37 | 0.19 | 0.00 | 0.19 | 0.20 | 0.00 | 0.00 |
| M. W. | 51.54 | 51.23 | 49.81 | 50.26 | 52.72 | 52.59 | 52.71 |
| Feed | | | | | | | |
| L-.Phase % | 96.38 | 96.71 | 95.50 | 95.70 | 100.00 | 100.00 | 100.00 |
| V-.phase % | 3.62 | 3.29 | 4.50 | 4.30 | 0.00 | 0.00 | 0.00 |
| Product | | | | | | | |
| L-.Phase % | 4.02 | 0.77 | 0.00 | 0.00 | 0.29 | 0.00 | 0.00 |
| V-.Phase % | 95.98 | 99.23 | 100.00 | 100.00 | 99.71 | 100.00 | 100.00 |
| Heat Vap*. | 0.0869 | 0.0914 | 0.0926 | 0.0927 | 0.0921 | 0.0928 | 0.0923 |

*Heat of vaporization, Kcal/Kg.

Examples 1 and 2

In examples 1, the feed at liquefaction condition is 96.38 and 3.62% in liquid phase and vapor phase respectively This means that, the mixture contains too much light hydrocarbon particularly methane. The product at vaporization condition is 4.02 and 95.98% in liquid and vapor phase, respectively. This means that the mixture contains too much heavy components, such as octane and heptane. Thus, mixture of example 1, fails to meet the requirement as a self-propelled liquid fuel in the present invention.

In example 2, the feed at liquefaction condition is 96.71 and 3.29%, respectively, in liquid phase and vapor phase. The product at vaporization condition is 99.23 and 0.77% in vapor and liquid phase respectively. The vaporization of product is improved over that of example 1, but it still incomplete. Consequently, the composition of example 2 fails to meet the requirement as a self-propelled liquid fuel in the present invention.

Examples 3 and 4

In example 3, the product at vaporization condition is 100 and 0% in vapor phase and liquid phase, respectively, indicating that it is completely vaporized, meeting one of the requirements. This also means that contents of the heavier component are not excessive. However, the feed at liquefaction condition is 95.50 and 4.50% in liquid and vapor phase, respectively, indicating that the feed is not completely liquefied and, there is too much light end in the mixture. Thus, mixture of example 3 fails to meet the requirement as a self-propelled liquid fuel in the present invention.

In example 4, the product is completely vaporized meeting one of the requirements as a self-propelled liquid fuel. However, the feed is not completely liquefied. Thus, the mixture of example 4 fails to meet the requirement as a self-propelled liquid fuel in the present invention.

Example 5

In example 5, methane is removed, so that the feed is completely liquefied, meeting one of the requirements. However, in the absence of the methane, the product is not completely vaporized. Thus, mixture of example 5 fails to meet the requirement as a self-propelled liquid fuel in the present invention.

Example 6 and 7

By adjusting the light and heavy ends of the mixtures properly, a fuel mixture meeting the two requirements for self-propelled liquid fuel of present invention can be prepared. In both examples of 6 and 7, the feeds are completely liquefied and the products are completely vaporized. Thus, mixtures of examples 6 and 7 meet the requirements as a self-propelled liquid fuel in the present invention.

It is remarkable that 20.17 and 20.69% of pentanes and heavier components can be accommodated in examples 6 and 7, respectively. Thus, the self-propelled liquid fuel in the present invention is the most profitable means to upgrade these low value by-products to premium fuels. In addition, 7.67 and 7.62% of low value ethane can be upgraded to premium product of self-propelled fuel in the present invention. Furthermore, addition of ethane as a propellant also improves the burning quality of the fuel mixture because of it's high H2 content as taught by U.S. Pat. Nos. 4,640,675 and 4,643,666. In short, the present invention provides an efficient and economical means to upgrade the low value refinery, gas, ethane, and pentane and heavier by-products to a premium liquid fuel.

Changes and modifications in the specifically described embodiments can be carried out without departing from the scope of the invention, which is intended to be limited only by the scope of the appended claims.

We claim:

1. A self-propelled liquid fuel composition for combustion in gaseous heater, comprising a. Preparing hydrocarbon mixtures of methane, ethane/ethylene, propane/propylene, butane/butene, pentane/pentene, hexane/hexene, heptane/heptene, and octane/octene, containing at least 1 wt % of ethane/ethylene as a propellant and at least 5 wt % of low value pentanes and heavier hydrocarbons, with vapor pressure equal or greater than 0 psig at ambient temperature in a container b. Pressurizing the hydrocarbon mixture to 150 psig higher to form liquid fuel c. Releasing the hydrocarbon mixtures at lower pressure to form gaseous fuel for combustion in heaters whereby a self-propelled liquid fuel for combustion in a gaseous heater is provided.

2. A composition according to claim 1, wherein the component concentrations of said mixture are in ranges of methane, 0 to 1%; ethane/ethylene, 1 to 15%; propane/propylene, 20 to 80%; butane/butene, 10 to 60%, pentane/pentene, 5 to 20%; hexane/hexane, 0 to 15%; heptane/heptene, 0 to 5% and octane/octane, 0 to 0.5%.

3. A composition according to claim 1, wherein ethane/ethylene is used as a propellant in a range of 1 to 15%.

4. A composition according to claim 1, wherein ratios of said hydrocarbon mixtures for propane/propylene to butane/butene is in a range of 3 to 0.5 and propane/propylene to pentane/pentene ratio is in a range of 10 to 1.5.

5. A composition according to claim 1, wherein said hydrocarbon mixture is liquid at ambient temperature and pressures of 400 psig or lower in said container.

6. A composition according to claim 1, wherein said mixture is gas at ambient temperature and pressure.

7. A composition according to claim 1, wherein said liquid fuel in said container, comprising a. Pumping pentane and heavier components into said container at atmospheric pressure b. Pumping butane/butene into said container at 25 to 200 psig c. Pumping in propane/propylene at 110 to 200 psig d. Pumping in methane and ethane/ethylene at 150 to 300 psig whereby a self-propelled liquid fuel with vapor pressure equals or greater than 0 psig at ambient temperature is provided.

8. A composition according to claim 1, wherein said liquid fuel in said container comprising:

a. Pumping in a refinery fuel gas stream containing methane, ethane/ethylene, propane/propylene, butane/butene, pentane/pentene, hexane/hexene, heptane/heptene and octane/octene of various compositions at 20 to 200 psig b. Pumping pentane and heavier components into said container at 20 to 200 psig c. Pumping butane/butene into said container at 25 to 200 psig d. Pumping in propane/propylene at 110 to 300 psig e. Pumping in methane and ethane/ethylene at 150 to 300 psig whereby a self-propelled liquid fuel with vapor pressure equals or greater than 0 psig at ambient temperature is provided.

9. A composition according to claim 1, wherein said liquid fuel is transferred from said container in liquid from to a smaller container with a capacity between about 5 to 100 kg for distribution to and application by consumers.

10. A composition according to claim 9, wherein said small container is a cylinder equipped with an inlet/exit opening and a means to control fuel pressure to a heater.

11. A composition according to claim 10, wherein said cylinder is equipped with means to release said mixture in liquid form exclusively.

12. A composition according claim 11, wherein said cylinder is equipped with an inlet/exit opening at the bottom.

13. A composition according to claim 11, wherein said cylinder is equipped with an inlet/exit opening connected to a tube reaching the bottom of said cylinder.

14. A composition according to claim 11, wherein said cylinder is further equipped with a heating means after said pressure controlling means to vaporize the exiting liquid fuel completely.

15. A composition according to claim 14, wherein said heating means include an electrical heater, use of a connecting tube in metal coil form for absorbing ambient heat and a heat exchanger to absorb heat from the heating media.

16. A composition according to claim 10, wherein said pressure controlling means is pressure regulator for pressure reduction.

* * * * *